US007654657B2

(12) United States Patent
Seshimo

(10) Patent No.: US 7,654,657 B2
(45) Date of Patent: Feb. 2, 2010

(54) LIQUID EJECTING APPARATUS

(75) Inventor: Tatsuya Seshimo, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 463 days.

(21) Appl. No.: 11/627,468

(22) Filed: Jan. 26, 2007

(65) Prior Publication Data

US 2007/0176984 A1 Aug. 2, 2007

(30) Foreign Application Priority Data

Jan. 27, 2006 (JP) ..... 2006-018609

(51) Int. Cl.
*B41J 2/175* (2006.01)

(52) U.S. Cl. ..... 347/85

(58) Field of Classification Search ..... 347/6–7, 347/21, 28; 47/85
See application file for complete search history.

(56) References Cited

U.S. PATENT DOCUMENTS 4,038,667 A * 7/1977 Hou et al. ..... 347/35
6,840,604 B2 * 1/2005 Kimura et al. ..... 347/85
7,293,849 B2 * 11/2007 Tani et al. ..... 347/6
2006/0152562 A1 * 7/2006 Ohishi ..... 347/85

FOREIGN PATENT DOCUMENTS

| | | |
|---|---|---|
| JP | 09-011498 | 1/1997 |
| JP | 09-267490 | 10/1997 |
| JP | 2002-254668 | 9/2002 |
| JP | 2003-200588 | 7/2003 |

* cited by examiner

*Primary Examiner*—Anh T. N. Vo
(74) *Attorney, Agent, or Firm*—Workman Nydegger

(57) ABSTRACT

A liquid ejecting apparatus includes a liquid ejecting head, a carriage carrying the liquid ejecting head, a plurality of subtanks carried on the carriage, a main tank disposed on a body of the apparatus, and a feed pipe. The carriage is moved back and forth in a main scanning direction. Each subtank contains a highly concentrated color ink which corresponds to one of the respective ink colors. The main tank contains a diluent containing no coloring component and/or a colorless ink. The diluent and/or the colorless ink is supplied from the main tank to the carriage through the feed pipe. The liquid ejecting head is supplied with the respective color inks and ejects the inks.

9 Claims, 5 Drawing Sheets

LIQUID EJECTING APPARATUS

BACKGROUND OF THE INVENTION

1. The Field of the Invention

The present invention relates to a liquid ejecting apparatuses. More specifically, the present invention relates to a liquid ejecting apparatus having a small-sized carriage for carrying a recording head.

2. The Relevant Technology

Several ink printers have been developed, each having a liquid ejecting apparatus, including a head that ejects liquid, such as ink. The liquid ink is usually contained in an ink cartridge, within the liquid ejecting head.

Currently, such ink printers for office use and commercial use consume large amounts of ink because their printing frequencies are high. In such high volume printers, it is necessary for those printers to have large-capacity ink cartridges. In printers having an on-carriage type printer, or a configuration wherein the carriage includes a cartridge holder for carrying ink cartridges, difficulties arise when the printer requires large-capacity ink cartridges. In order to accommodate the larger ink cartridges, the carriage is increased in size, which also increases the load applied on the printer while moving the carriage.

FIG. 6 shows a carriage 1 carrying on-carriage type ink cartridges of the variety described above. As illustrated, a plurality of ink cartridges 2 containing different color inks are mounted on the carriage 1. In order to accommodate the large ink cartridges 2, the carriage 1 has a large size. As a result, the carriage 1, also has a large weight, and is generally not suitable for use in small-sized liquid ejecting apparatuses, such as the compact printers which are popular today.

One common approach used to solve this problem is an off-carriage type printer, where the ink cartridges are disposed away from the carriage. In the off-carriage type printer, it is necessary to move the different color inks from respective ink tanks arranged in a body of the printer to the carriage, or more specifically, to a series of subtanks on the carriage. Additionally, the carriage must remain movable in a main scanning direction.

It is therefore necessary to use a thick or multilayer tube as a feed pipe in order to prevent evaporation of water from each ink supply and to arrange a plurality of thick or multilayer tubes corresponding to the different color inks.

For example, Japanese Patent Application Number JP-A-9-11498, as illustrated in FIG. 7, discloses an ink jet recording apparatus having a carriage 3 carrying a plurality of small-sized subtanks (not shown). In this apparatus, each highly concentrated color ink is diluted in a body of the apparatus and is then supplied to the corresponding subtank on the carriage every printing. Additionally, the described ink jet recording apparatus takes countermeasures to reduce the evaporation of water from each supplied ink.

Disadvantageously, however, since the apparatus has a structure in which a plurality of ink cartridges are arranged in the apparatus body, each color ink is diluted in the apparatus body, and the diluted ink is then supplied to the corresponding subtank on the carriage. Thus it is necessary to connect a plurality of tubes 4 to the carriage 3 moved in the main scanning direction in a manner similar to the off-carriage type.

Unfortunately, however, in many small-sized liquid ejecting apparatuses, the power of a driving unit which moves the carriage is limited. Accordingly, the structure in which a plurality of or many tubes are connected to a carriage and the carriage is moved in the main scanning direction has a disadvantage in that the resistance to the movement is higher as the number of tubes is larger. Thus, it is difficult for the driving unit to move the carriage in the main scanning direction.

BRIEF SUMMARY OF THE INVENTION

The present invention provides a liquid ejecting apparatus with a reduced size, including a single tube which is arranged on a carriage.

According to one embodiment of the invention, the system includes a liquid ejecting apparatus including a liquid ejecting head, a carriage carrying the liquid ejecting head, a plurality of subtanks carried on the carriage, a main tank disposed on a body of the apparatus, and a feed pipe. The carriage is moved back and forth in a main scanning direction. Each subtank receives a highly concentrated color ink, corresponding to the respective ink colors. The main tank contains a diluent containing no coloring component and/or a colorless ink. The diluent and/or the colorless ink is supplied from the main tank to the carriage carrying the subtanks through the feed pipe. The liquid ejecting head is supplied with the respective color inks and ejects the inks.

The structure also includes a series of subtanks, each storing highly concentrated color inks, which are carried on the carriage. Accordingly, one advantage of the present invention is that the carriage can be small and light in a manner similar to the known off-carriage type one. The carriage is suitable to reduce the size of the apparatus.

The structure also includes a main tank, disposed in the apparatus body, which contains a diluent containing no coloring component and/or a colorless ink. Since the respective color inks are not supplied from the apparatus body to the carriage, the single feed pipe can be arranged between the main tank and the carriage so as to supply the diluent and/or the colorless ink to each subtank.

In addition, even if evaporation of water from the diluent and/or the colorless ink occurs in the feed pipe, the evaporation does not immediately affect ink quality. It is therefore unnecessary to use a thick or multilayer tube, i.e., a tube having a high flexing resistance as a feed pipe. Consequently, the power required to move the carriage is smaller since the weight of the carriage is lighter. Thus, the liquid ejecting apparatus may be reasonably reduced in size and more easily powered.

The liquid ejecting apparatus of the present invention is generally useful in ink jet printers which eject ink droplets. The ink droplets may be ejected onto any number of objects, including, but not limited to printing media or paper. The invention is therefore generally applicable any number of liquid ejecting apparatuses which use ink.

Preferably, the diluent and/or colorless ink is supplied from the outlet of the feed pipe to each of the respective subtanks in the carriage.

Within this structure, the diluent and/or colorless ink is supplied to each subtank storing the highly concentrated ink on the carriage. There, the highly concentrated ink is diluted to an appropriate concentration.

Preferably, the apparatus further includes a plurality of branch pipes extending from the feed pipe. The branch pipes are connected to each of the subtanks corresponding to the various ink colors. Thus the subtanks, the branch pipes, and a plurality of ink cartridges respectively containing highly concentrated color inks are arranged within the structure of the carriage.

Within this structure, the subtanks corresponding to the respective ink colors and each of the ink cartridges containing the highly concentrated color ink are arranged in the carriage.

The highly concentrated color ink is supplied from each ink cartridge to the corresponding subtank. The diluent containing no coloring component and/or colorless ink is supplied from the main tank disposed in the apparatus body to the carriage through the feed pipe. Next, the coloring component and/or colorless ink is supplied to each subtank through a corresponding branch pipe. Consequently, the highly concentrated color ink is diluted to an appropriate concentration in each subtank.

BRIEF DESCRIPTION OF THE DRAWINGS

The invention will be described with reference to the accompanying drawings, wherein like numbers reference like elements.

DETAILED DESCRIPTION OF EXEMPLARY EMBODIMENTS

A preferred embodiment of the invention will now be described with reference to the drawings.

Figure 1:
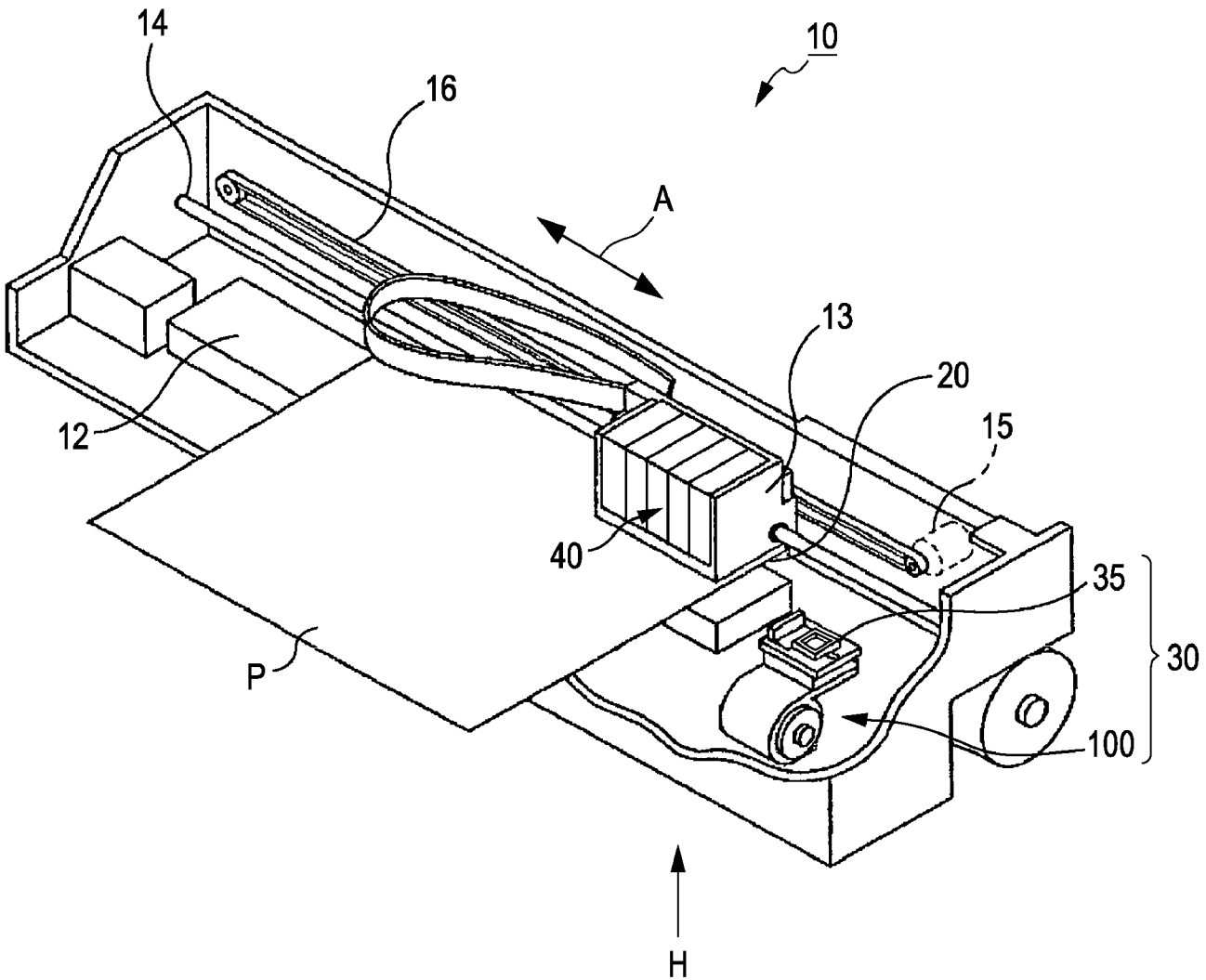
FIG. 1 is a schematic perspective view of a printer serving as a liquid ejecting apparatus according to an embodiment of the invention.
Figure 2:
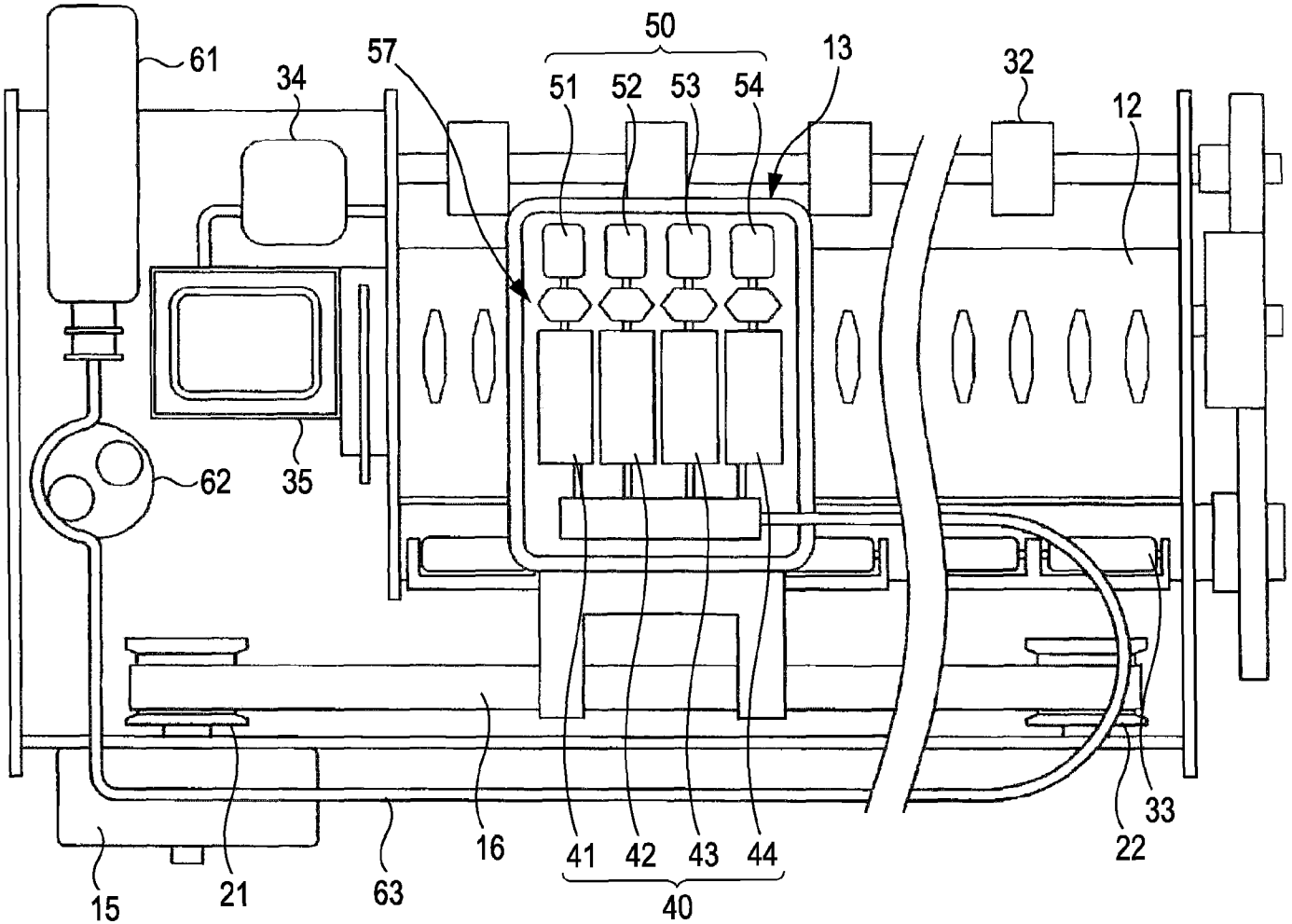
FIG. 2 is a schematic diagram of the printer of FIG. 1.

FIG. 1 is a schematic perspective view of essential part of a printer, used as an example of a liquid ejecting apparatus, which serves as an ink jet recording apparatus. FIG. 2 is a plan view schematic, illustrating the components in a casing constituting a body of the printer.

Referring to FIGS. 1 and 2, subtanks 40 are carried on a carriage 13 arranged in the body of a printer 10. The printer 10 also includes subtanks 40 and ink cartridges, each serving as a cartridge containing a highly concentrated liquid, which are each carried on the carriage 13. The ink cartridges will be described in more detail below. The large-capacity main tank used for storing a diluent containing no coloring component for dilution of ink is arranged in the body of the printer 10 and is not mounted on the carriage 13. The printer 10 is, therefore, an off-carriage type.

Referring to FIG. 1, the carriage 13 is attached to an endless timing belt 16 stretched between a driving pulley 21 and a driven pulley 22. A carriage motor 15 drives the timing belt 16, so that the carriage 13 is moved back and forth in a main scanning direction (shown by an arrow A in FIG. 1) while being guided through a guide member (guide shaft) 14.

A recording head 20, serving as a liquid ejecting head having a plurality of nozzles, is attached to the lower surface of the carriage 13. A paper feed motor (not shown), serves as a driving source for paper feed, and is disposed in a lower end of the printer 10. A gear is fixed to an output shaft of the paper feed motor. The gear is connected to paper feed rollers 32 and paper ejection rollers 33 through a gear train.

In other words, when the paper feed motor is rotated, the paper feed rollers 32 and the paper ejection rollers 33 are rotated, so that a sheet P is transported in a sub-scanning direction (in the vertical direction in FIG. 2) along a platen 12.

Referring to FIG. 1, a home position H is located in one end of the guide member 14. The home position H indicates a non-printing area located at one end of a traveling path of the carriage 13. In the home position H, a head cleaning mechanism 30 is arranged. The head cleaning mechanism 30 has a function of preventing the drying of ink in the orifice of each nozzle of the recording head 20. The head cleaning mechanism 30 also has the function of applying a negative pressure generated by a suction pump 34 to forcefully suck and remove the ink from the orifice of each nozzle. In other words, after the carriage 13 is moved and the recording head 20 is moved downward and is then fitted into a cap 35, the suction pump 34 sucks air from inside the cap 35 to generate a negative pressure and allows an absorbing member composed of, for example, sponge in the cap 35 to absorb any residual ink from the nozzles of the recording head 20. The recording head 20 is cleaned in this manner.

Figure 3:
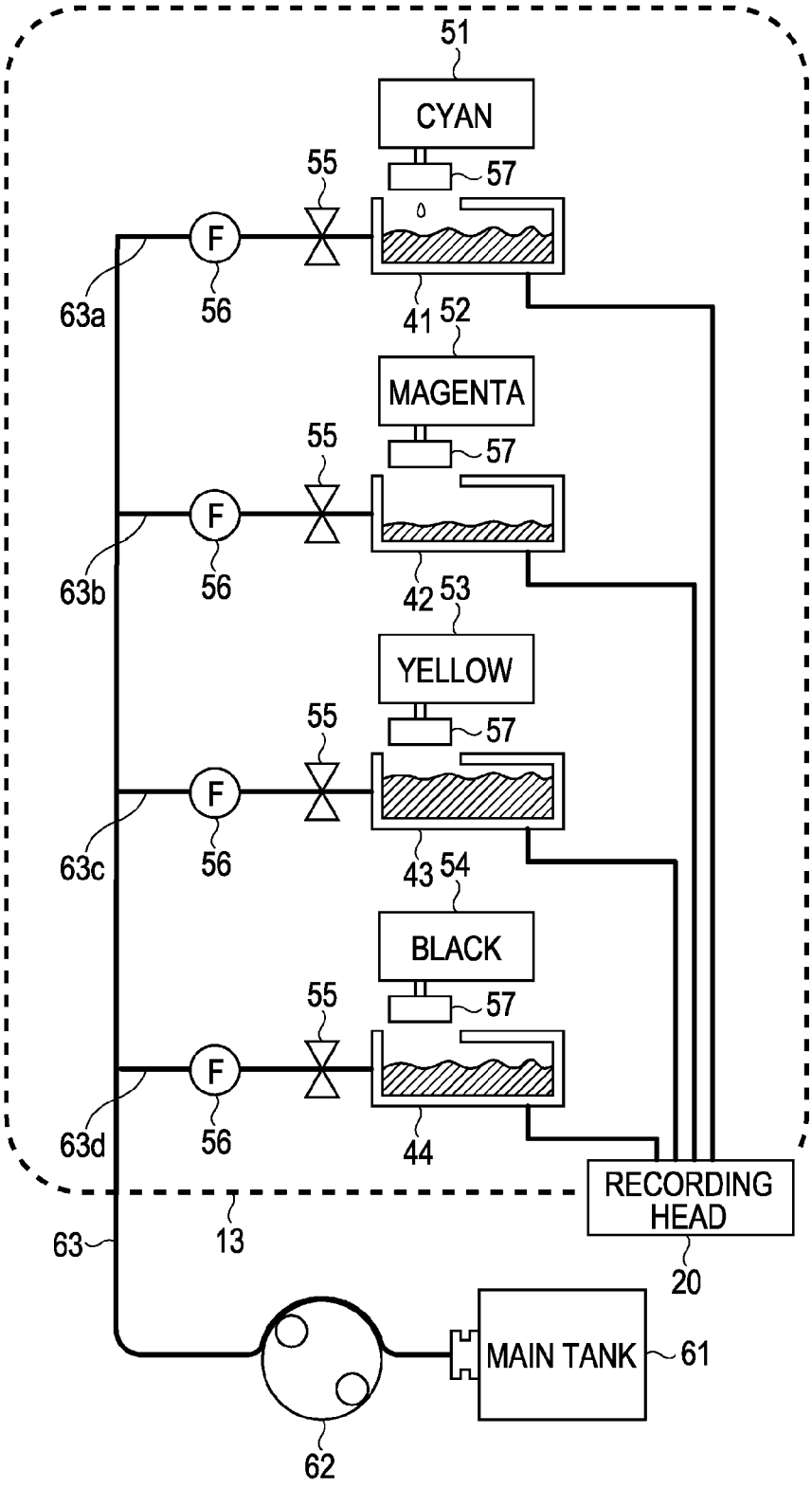
FIG. 3 is a schematic diagram showing the structure of components arranged in a carriage of the printer.

Together with FIG. 2, FIG. 3 is a diagram showing the relationship between the carriage 13 and a main tank 61 disposed in the body of the apparatus (printer). The carriage 13 carries the subtanks 40 from which the inks are supplied to the recording head 20. Preferably, the subtanks 40 correspond to each of the different ink colors arranged in the carriage 13. In the exemplary embodiment illustrated in FIG. 3, four subtanks 41-44 are used.

The carriage 13 further has ink cartridges 50 connected to the respective subtanks 40. In this exemplary configuration, the ink cartridges 51-54 correspond to each of the respective colors which are used. Advantageously, the size and weight of each of the ink cartridges 51-54 is less than those of known ink cartridges containing a concentrated color ink.

The ink cartridges 51-54 are connected to the subtanks 41-44 through a series of dispenser mechanisms 57 shown in FIG. 3. Typically, the number of ink cartridges and subtanks correspond to the number of ink colors. The ink colors include, for example, black, yellow, magenta, and cyan. Each dispenser mechanism 57 can be controlled by a drive voltage using, for example, a piezoelectric device.

Since there are four ink colors used in this exemplary configuration, four subtanks and the four ink cartridges are shown in FIGS. 2 and 3. One of skill in the art would understand that the number of ink colors may be less or more than four and that the number shown in the diagrams is merely one example of an acceptable arrangement.

The main tank 61 is arranged in the body of the apparatus serving as the printer 10, and typically contains a relatively large amount of diluent for dilution of a highly concentrated ink supplied from each ink cartridge 50 to the corresponding subtank 40. Thus, the highly concentrated ink is diluted so as to have an appropriate concentration. The liquid contained in the main tank 61 may include a colorless ink, i.e., a gloss ink having no color instead of or in addition to the diluent.

A feed pipe 63 is connected to the main tank 61. A feed pump 62 including, for example, a tube pump supplies the diluent into the main tank 61, and later to the subtanks 41-44. Specifically, the diluent is supplied to the subtanks 41-44 through the outlets of branch pipes 63*a*, 63*b*, 63*c*, and 63*d*, which extend from the rear end of the feed pipe 63 and connect to the subtanks for each color of ink.

Each of the branch pipes 63*a*, 63*b*, 63*c*, and 63*d* have a flow measuring unit 56 including, for example, a flow sensor, and a sealing valve 55 used for opening and closing a flow passage in each branch pipe. The sealing valve 55 is arranged downstream of the flow measuring unit 56.

Figure 4:
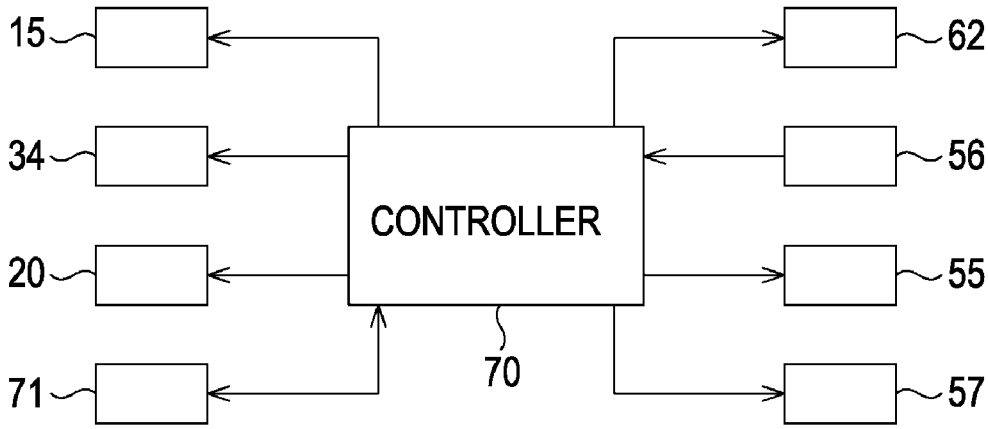
FIG. 4 is a block diagram showing the electrical structure of the printer.

FIG. 4 is a block diagram showing the electrical structure of a control mechanism for the printer 10. The controller 70 includes a computer which is incorporated as a control board within the printer 10. The controller 70 mainly performs necessary arithmetic operations using a software stored in a memory 71 in order to control the operation of the printer 10.

According to one embodiment, each of the above-described various components are connected to the controller 70. For example, the carriage motor 15, suction pump 34, recording head 20 (including the driving elements, such as the piezoelectric devices located in the respective nozzles), and the memory 71 are each connected to the controller 70. Additionally, the feed pump 62, flow measuring units 56, sealing valves 55, and dispenser mechanisms 57 are also connected to the controller 70.

According to one embodiment, the printer of the present invention has the above-described structure. Returning to FIGS. 1-4, subtanks 41-44 store highly concentrated color inks supplied from the respective ink cartridges 51-54. For example, the diluent is supplied to the subtanks 41-44 by driving the feed pump 62. In each of the branch pipes 63*a*, 63*b*, 63*c*, and 63*d*, the flow of the diluent is measured by a flow measuring unit 56 and is supplied to a corresponding subtank.

Consequently, the subtanks 41-44 store the respective color inks in an appropriate concentration. A pressure applied to each stored color ink is controlled to match a predetermined value and the resulting ink is then supplied to the recording head 20.

In other words, the inks are temporarily stored in the subtanks 41 to 44 and are then supplied to the recording head 20 while under controlled pressure. The printer 10 executes a printing process through the controller 70 on the basis of printing data transmitted from a host computer or a memory card. During the printing process the controller 70 drives the carriage motor 15 and the paper feed motor and controls the recording head 20 to eject the inks onto the printing medium.

The carriage 13 of the printer 10 carries the small-sized ink cartridges 50, each containing a concentrated ink, and the subtanks 41-44. Advantageously, the size and weight of the carriage 13 can be reduced to sizes comparable to those of known off-carriage type printers. Consequently, the carriage 13 of the present embodiment is useful in a reduced-size apparatus.

Figure 5:
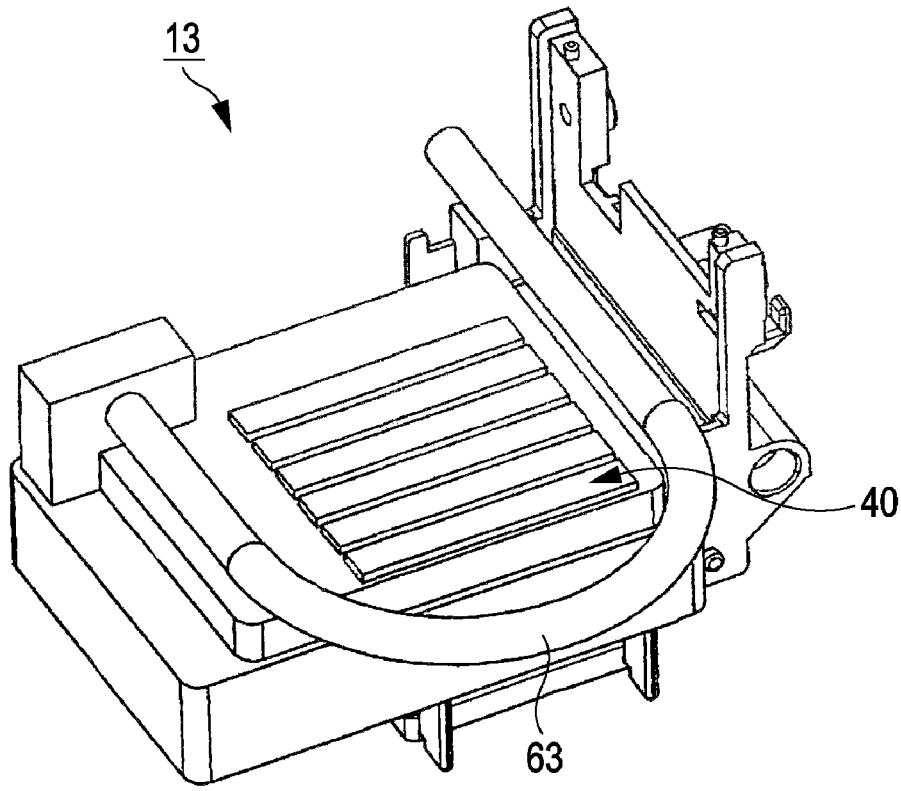
FIG. 5 is a perspective view of essential part of the carriage of the printer of FIG. 1.
Figure 6:
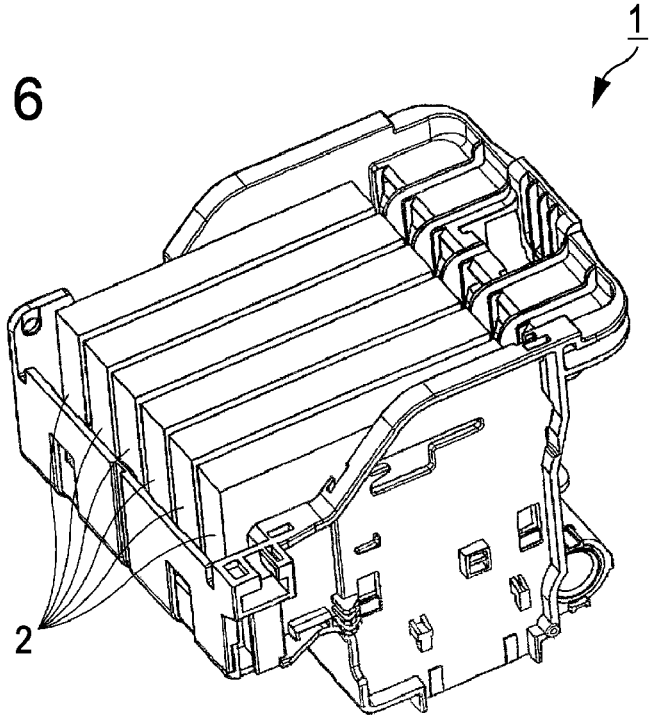
FIG. 6 is a schematic perspective view of a carriage of a printer known in the present art.
Figure 7:
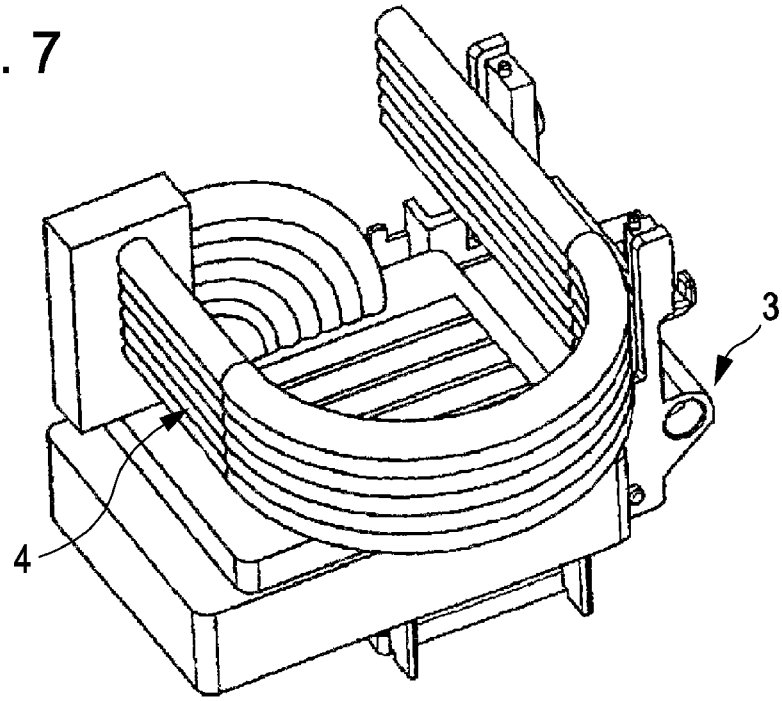
FIG. 7 is a perspective view of essential part of the carriage of FIG. 6.

Additionally, since the main tank 61, arranged in the body of the apparatus, stores the diluent which contains no coloring component and/or colorless ink together with the feed pipe 63 which supplies the diluent to each of the subtanks 41-44 mounted on the carriage 13. As illustrated in FIG. 5, one advantage of the present invention the ability for a single feed pipe 63 to supply a plurality of color inks to the carriage 13.

Advantageously, in situations where there is evaporation of water in the feed pipe, the evaporation does not immediately affect the quality of the colored inks. Thus, in the described embodiment, it unnecessary to use a thick tube or a highly rigid multilayer tube, i.e., a tube having a high flexing resistance, as a feed pipe in order to prevent the evaporation of water therein. Thus, the power required for movement of the carriage can become smaller due to the light weight of the carriage. Consequently, the printer reasonably reduced in size and power can be provided.

As previously mentioned, the diluent and/or colorless ink is supplied to each of the respective subtanks 41-44 in the carriage 13. Since the diluent and/or colorless ink is supplied to each subtank previously storing a highly concentrated ink, the ink is diluted to an appropriate concentration within each subtank 41-44.

Within the carriage 13, the ink cartridges 51 to 54 each containing a highly concentrated color ink are arranged so as to correspond to the respective subtanks 41-44. The highly concentrated color ink is supplied from each ink cartridge to the corresponding subtank 41-44.

The diluent containing no coloring component and/or colorless ink is stored in the main tank 61 disposed in the body of the apparatus and is supplied through a feed pipe 63 to the carriage 13. In the carriage 13, the diluent and/or the colorless ink is supplied through each branch pipe 63*a-d* to the corresponding subtank 41-44. Consequently, the highly concentrated color ink is diluted in each subtank 41-44 so as to result in an appropriate concentration. The resulting color ink can be used for printing.

The invention is not limited to the configuration described above and one of skill in the art would understand that different components may be used in connection with the present invention. By way of example, the above description describes a configuration wherein one ink cartridge is provided for each subtank 40 in the carriage 13. Alternatively, any number of ink cartridges may correspond to each subtank or at least one of subtanks.

The process, methods of use and examples of components listed in the invention are illustrative and not inclusive. The invention may be embodied in other specific forms without departing from its spirit or essential characteristics. The described embodiments are to be considered in all respects only as illustrative and not restrictive. The appended claims are presented to illustrate the embodiments of the invention disclosed herein.

What is claimed is:

1. A liquid ejecting apparatus comprising:

a liquid ejecting head;

a carriage carrying the liquid ejecting head, the carriage being moved back and forth in a main scanning direction;

a plurality of subtanks carried on the carriage, each subtank receiving a highly concentrated color ink, the subtanks corresponding to respective ink colors;

a single main tank disposed on a body of the apparatus, the main tank containing a diluent containing no coloring component and/or a colorless ink; and a single feed pipe through which the diluent and/or the colorless ink is supplied from the single main tank to the carriage carrying the subtanks, such that the diluent and/or colorless ink from the single main tank is mixed at the carriage with the highly concentrated color ink in each of the plurality of subtanks, the liquid ejecting head being supplied with the respective color inks and ejecting the inks.

2. The apparatus according to claim 1, wherein the diluent and/or the colorless ink is supplied from the outlet of the feed pipe to the respective subtanks in the carriage.

3. The apparatus according to claim 2, further comprising:

a plurality of branch pipes extending from the feed pipe and connecting to the respective subtanks corresponding to the respective ink colors, wherein the subtanks, the branch pipes, and the plurality of ink cartridges containing the highly concentrated color inks are arranged in the carriage.

4. A liquid ejecting apparatus comprising:

a liquid ejecting head;

a carriage carrying the liquid ejecting head, the carriage being configured to move back and forth in a main scanning direction;

a plurality of subtanks carried on the carriage, each subtank being configured to receive a highly concentrated color ink, the subtanks corresponding to respective ink colors;

a single main tank disposed on a body of the apparatus, the main tank containing a diluent with no coloring component and/or a colorless ink; and a single feed pipe through which the diluent and/or the colorless ink can be supplied from the main tank to the carriage carrying the subtanks, a plurality of branch pipes extending from the feed pipe and connecting to the respective subtanks corresponding to the respective ink colors, such that the liquid ejecting head can receive the diluent and/or colorless ink from the main tank and mix the diluent or colorless ink at the carriage with the highly concentrated color ink in each of the plurality of subtanks and eject the respective color inks.

5. The apparatus according to claim 4, wherein the subtanks, the branch pipes, and the plurality of ink cartridges containing the highly concentrated color inks are arranged in the carriage.

6. The apparatus according to claim 4, wherein the outlet of the feed pipe is capable of supplying the diluent and/or the colorless ink to the respective subtanks in the carriage.

7. The apparatus according to claim 6, wherein the respective subtanks in the carriage are configured to combine the highly concentrated color ink is with the diluent and/or colorless ink.

8. The apparatus according to claim 7, further comprising:

a series of flow controlling units for supplying the diluent and/or colorless ink from the branch pipes into the subtanks.

9. The apparatus according to claim 8, wherein each of the flow controlling units comprises a flow sensor and sealing valve.

* * * * *

UNITED STATES PATENT AND TRADEMARK OFFICE

CERTIFICATE OF CORRECTION

PATENT NO. : 7,654,657 B2
APPLICATION NO. : 11/627468
DATED : February 2, 2010
INVENTOR(S) : Tatsuya Seshimo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 470 days.

Signed and Sealed this

Twenty-eighth Day of December, 2010

David J. Kappos

David J. Kappos
*Director of the United States Patent and Trademark Office*